US006317033B1

(12) United States Patent
Kobayashi et al.

(10) Patent No.: US 6,317,033 B1
(45) Date of Patent: Nov. 13, 2001

(54) VEHICLE HORN

(75) Inventors: Yoshikazu Kobayashi, Ashikaga; Kazuo Igarashi, Kiryu; Kiyofumi Nakayama, Sawa-gun, all of (JP)

(73) Assignee: Mitsuba Corporation, Gunma-ken (JP)

( * ) Notice: Subject to any disclaimer, the term of this patent is extended or adjusted under 35 U.S.C. 154(b) by 0 days.

(21) Appl. No.: 09/562,766

(22) Filed: May 2, 2000

(30) Foreign Application Priority Data

May 7, 1999 (JP) ..... 11-126997

(51) Int. Cl.[7] ..... G10K 9/00

(52) U.S. Cl. ..... 340/388.1; 340/384.73; 381/389

(58) Field of Search ..... 340/384.1, 384.4, 340/384.73, 388.1; 381/389, 199, 343

(56) References Cited

U.S. PATENT DOCUMENTS 4,149,153 * 4/1979 Shigemori et al. ..... 340/384.73
5,218,337 * 6/1993 Peter ..... 340/388.1
5,715,324 * 2/1998 Tanabe et al. ..... 381/199
5,933,508 * 8/1999 Fuke et al. ..... 381/343

FOREIGN PATENT DOCUMENTS

58162197-A * 9/1983 (JP) .
61109288-A * 5/1986 (JP) .
09135495-A * 5/1997 (JP) .

* cited by examiner

*Primary Examiner*—Daniel J. Wu
(74) *Attorney, Agent, or Firm*—Oliff & Berridge, PLC

(57) ABSTRACT

The present invention is structured so as to prevent a fixing part from becoming an obstacle when fixing a coil bobbin for a horn for a vehicle to a case. The structure of the present invention is achieved by forming a tubular through hole extending toward the case opening side at a second bottom surface of the case; piercing a mounting hole through the case mounting piece of the coil bobbin; externally fitting the mounting hole over the tubular through hole; and folding the penetrating tip end of the tubular through hole tube as a folded tip portion toward the side of the hole peripheral edge of the mounting hole and engaging the penetrating tip end, as the folded tip portion, into a large hole part formed in the hole end of the mounting hole, whereby a mounting hole is fixed so as to be pinched by the second bottom surface and the folded tip portion.

6 Claims, 4 Drawing Sheets

VEHICLE HORN

BACKGROUND OF THE INVENTION

1. Field of Invention

The present invention relates to a horn for a vehicle, and specifically to a horn that is mounted on a vehicle, such as an automobile or a motorcycle.

2. Description of Related Art

Some horns for vehicles have a structure in which a vibration generating member that includes an electromagnet is accommodated in a cylindrical case having a bottom, and sound is produced by vibrating a diaphragm formed integrally with the opening of the case in accordance with the vibration of the vibration generating part. In this type of horn for a vehicle, since the coil bobbin around which a coil is wound to form an electromagnet produces the vibration of the diaphragm, it is necessary to securely fix the coil bobbin to the bottom surface of the case. To achieve this, a conventional horn fixes the coil bobbin to the case by providing a plate fixed to the case at the surface on the case opening side of the coil bobbin as a bridge between the coil bobbin and the case. However, this creates a problem in that there is a need for a plate and for fixing members for fixing the coil bobbin to the case in at least two places, which results not only in an increase in the number of components, but also an increase in the number of operations necessary for assembly.

One proposed solution is to directly fix the coil bobbin to the case by caulking as proposed in, for example, JP-U-6-73799, which discloses a horn for a vehicle wherein a tightening part protrudes from a coil bobbin formed of a thermoplastic resin material, and wherein the tightening part is inserted into a through hole formed in the cylinder bottom part of the case so that the penetrating tip end thereof is heat-caulked outside the case, whereby members such as a plate and the like are unnecessary.

In the above-described conventional horn, the heat-caulked part of the coil bobbin is exposed. However, since the coil bobbin is formed of a resin material, the heat-caulked part can be damaged when hit by stones and the like. In order to avoid this, it is necessary for the horn to have a structure so as to protect the heat-caulked part by a stay for supporting and fixing the horn on a car frame (car body). If this is done, however, a problem arises in that the surface-to-surface contact structure between the case bottom part and the stay becomes inadequate, resulting in a decrease in strength of the horn. Furthermore, in this case, it is necessary to increase the strength of the flange part of the protruding tightening part side to strongly fix the bobbin itself to the case. In order to do this, the flange part where the tightening part is formed should be thick-walled. However, this creates a problem in that the coil winding part of the coil bobbin would shift toward the opening side by the increment of the thickness of wall, whereby the horn would increase in thickness, leading to an overall increase in the size thereof. This is one of the problems that the present invention aims to solve.

Also, such a horn for a vehicle produces sound by forcing a diaphragm to vibrate, and since, if a difference in pressure occurs between the inside and outside of the case, the smooth vibration of the diaphragm is impaired, producing a unstable production of sound. In order to avoid this, it is necessary to add a ventilation hole to equalize the pressure between the interior and the exterior. This raises another issue of complicating manufacturing, which is another of the problems that the present invention aims to solve.

SUMMARY OF THE INVENTION

Accordingly, it is an object of the present invention to solve the above-described problems and to provide a horn for a vehicle comprising a cylindrical case and a coil bobbin for generating a diaphragm vibration, said case having an opening covered by a diaphragm and a bottom in which the coil bobbin is mounted, wherein a tubular through hole is formed at the case bottom so as to protrude toward the case opening, said tubular through hole being fitted by and penetrating a corresponding mounting hole formed in the coil bobbin and the penetrated tip portion of said tubular through hole being expandingly folded onto the hole edge of the mounting hole so as to hold the coil bobbin between the case bottom and said folded tip portion.

By the above-described structure of the present invention, the fixing member for fixing the coil bobbin to the cylinder bottom can be prevented from being exposed on the bottom side.

The tubular through hole of the present invention may be structured so as to also serve as a ventilation hole for the case, which permits a reduction in the number of components and simplification of the production process.

Furthermore, at the bent portion of the tubular through hole of the present invention, a filter which is not only air-permeable but which is also waterproof may be provided so as to seal the tubular through hole, which permits the case to be waterproof.

Moreover, the mounting hole of the present invention may be formed in the mounting piece protruding through the coil bobbin in the direction of the outer diameter, and a larger diameter hole portion engaged by the folded tip portion is formed at the end portion of said mounting hole on the side of the case opening.

Furthermore, the filter of the present invention may be provided so as to extend to the mounting piece past the folded tip portion, which allows improved waterproofing.

In addition, the surface of the mounting piece on the side of the case opening is substantially either flush with or greater in height than that of the folded tip portion on the side of the case opening.

BRIEF DESCRIPTION OF THE DRAWINGS

The above and other objects, features, and advantages of the present invention will be apparent from the following detailed description of the preferred embodiment of the invention in conjunction with the accompanying drawings, in which.

DETAILED DESCRIPTION OF PREFERRED EMBODIMENTS

An embodiment of the present invention will be described below with reference to FIGS. 1 and 2.

Figure 1:
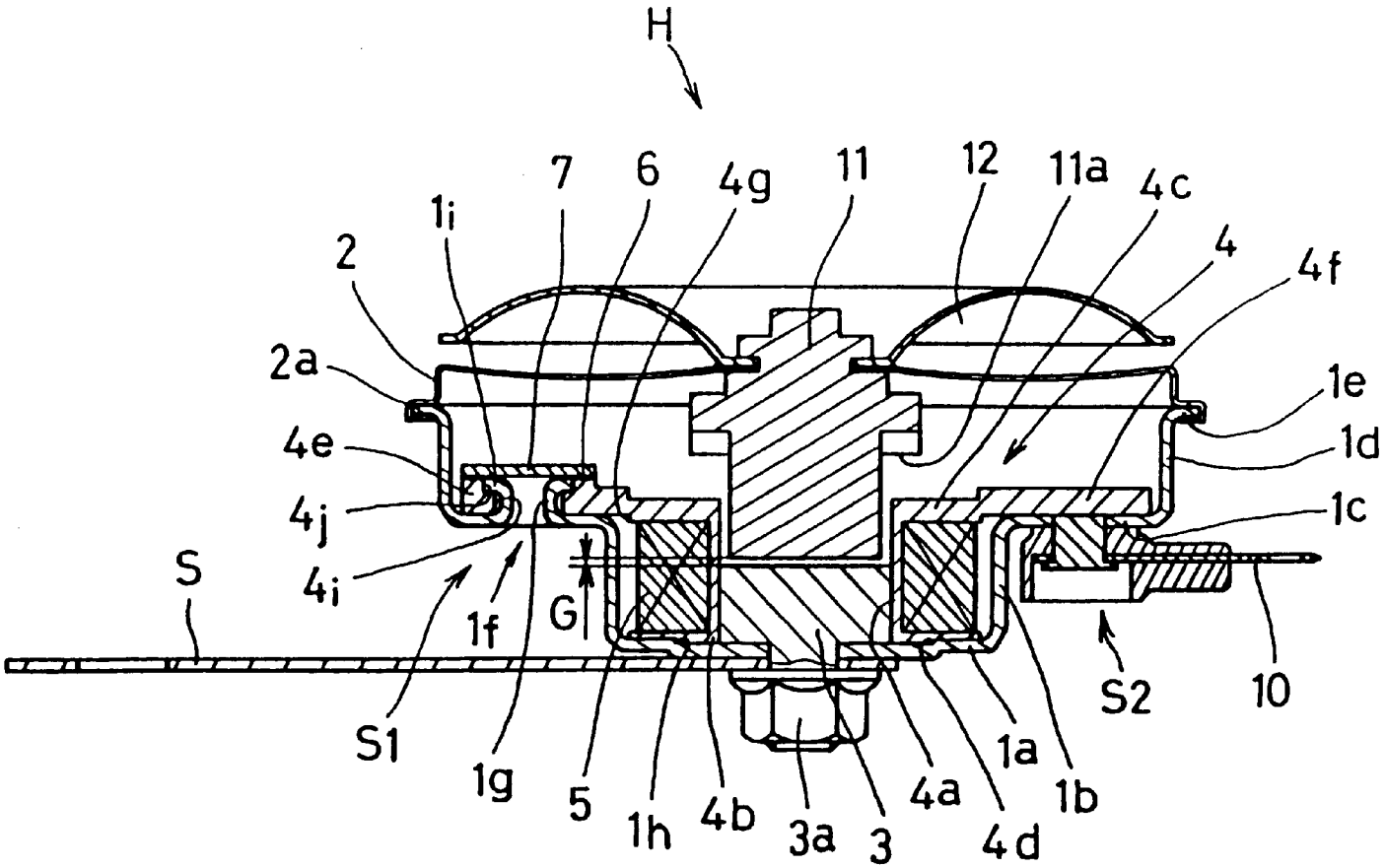
FIG. 1 is a sectional side view of a horn for a vehicle.
Figure 2:
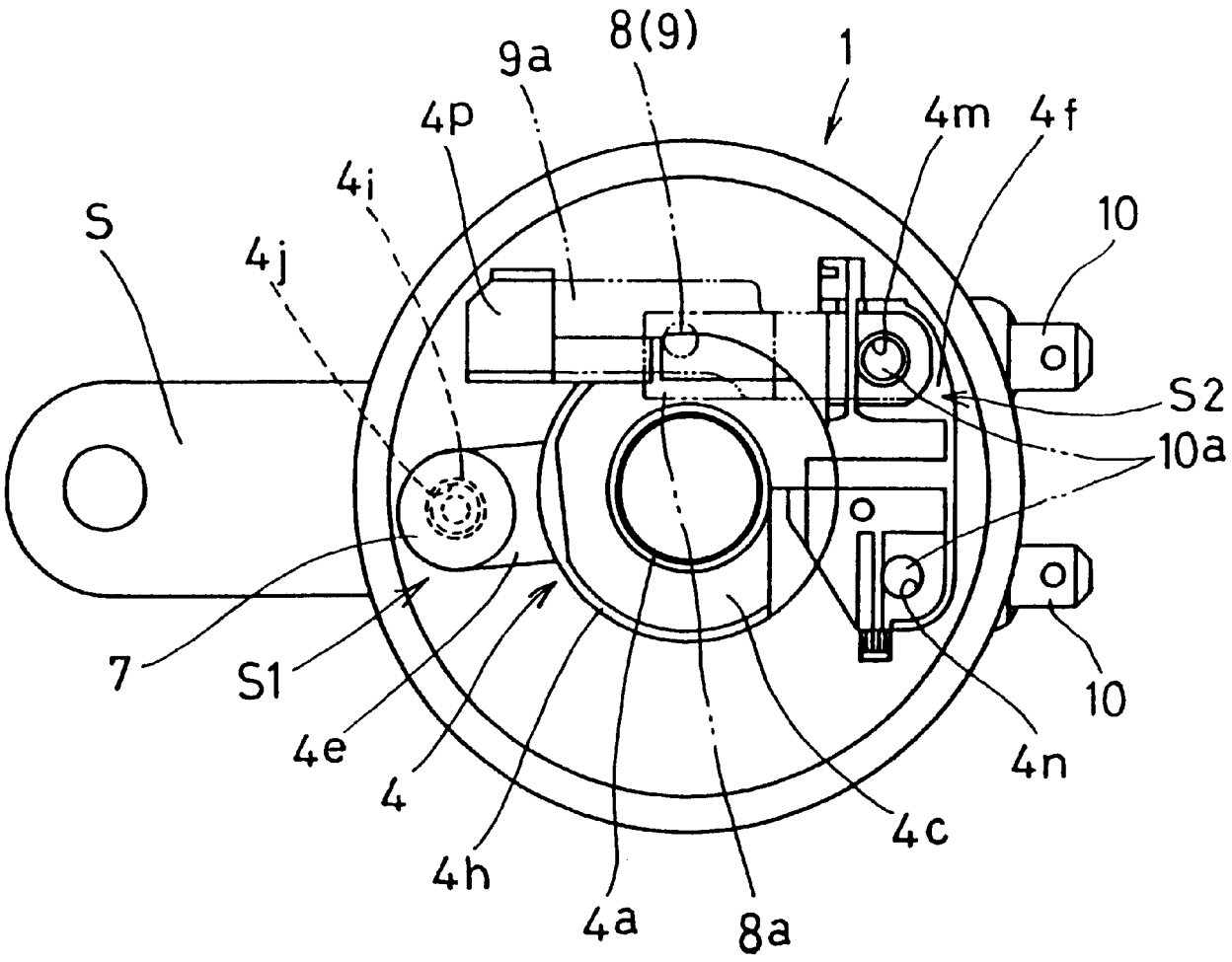
FIG. 2 is a front view showing a case housing a coil bobbin.
Figure 3A:
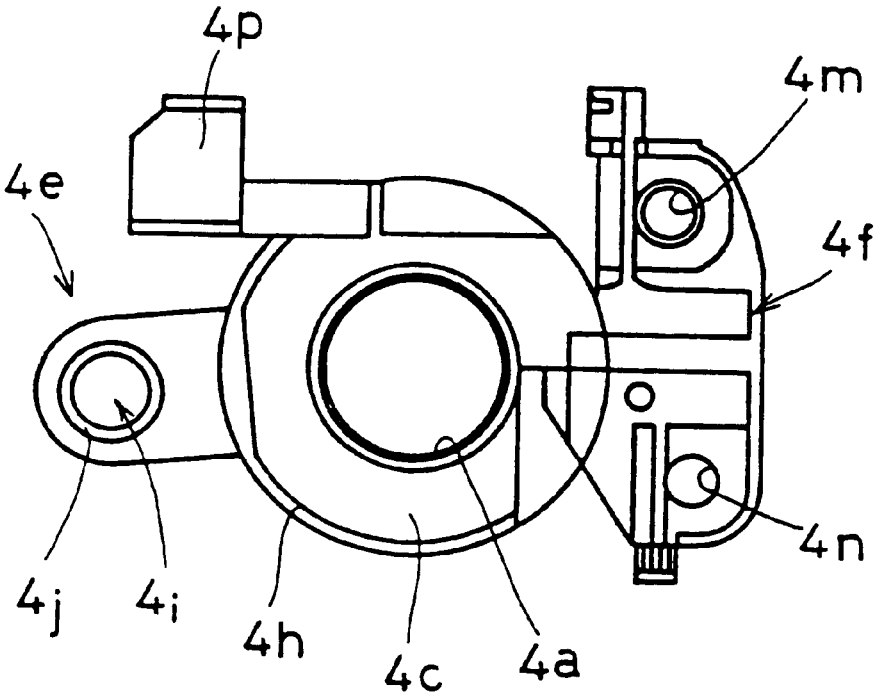
FIG. 3A is a front view of a coil bobbin.
Figure 3B:
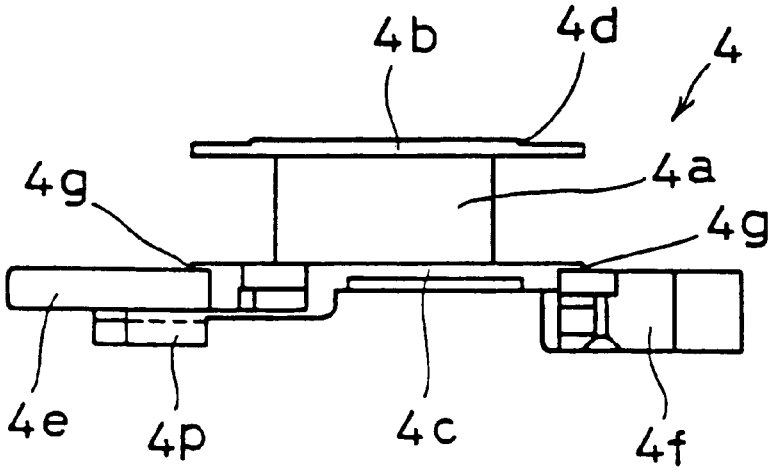
FIG. 3B is a plan view of FIG. 3A.
Figure 4:
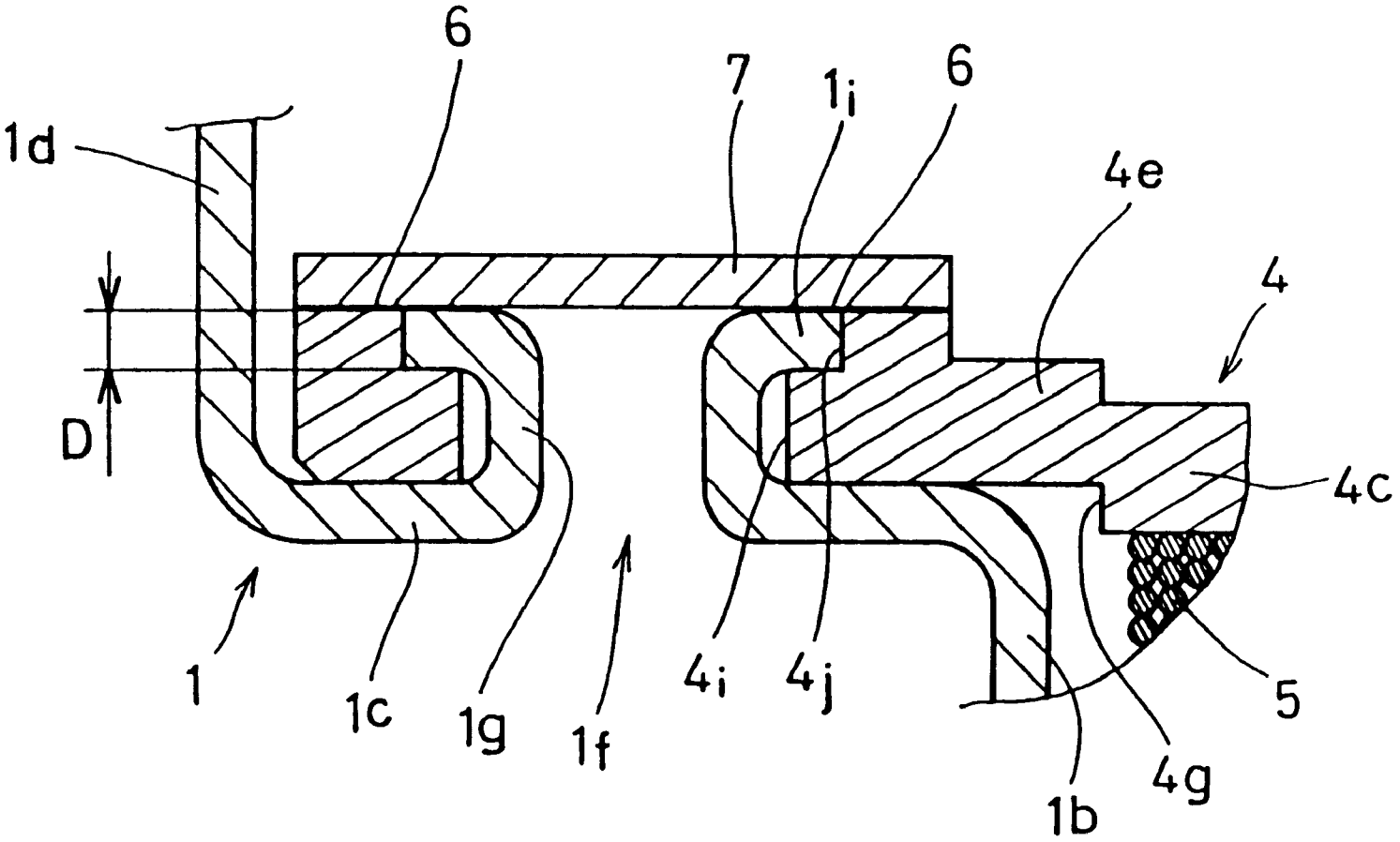
FIG. 4 is a partially enlarged view of a main section.

Referring to FIG. 1, there is shown a case 1 comprising a horn for a vehicle. The case 1 is cylindrical in shape with a bottom and an open end, and comprises a smaller diameter portion 1*b* having a first bottom surface la formed at the bottom end, and a larger diameter portion 1*d* having a second bottom surface 1*c* with a step relative to the smaller diameter portion 1*b*. The first bottom surface 1*a* and the second bottom surface 1*c* correspond to the case bottom of the present invention, and they are formed so as to be cylinder bottom surfaces substantially parallel with each other. At the peripheral edge (opening edge part) of the larger diameter portion 1*d*, there is formed a flange 1*e* expanded in the direction of the outer diameter, and the outer peripheral edge 2*a* of a diaphragm 2 (described later) is folded back and fixed to the flange 1*e* by caulking.

On the other hand, a fixed iron core 3 is screwed onto and penetrates the first bottom surface 1*a* at the center so as to be freely adjustable in the longitudinal direction. Here, reference numerical 3*a* denotes a fixing nut. A coil bobbin 4 (described later) is fixed to the second bottom surface 1*c*, and the tubular through hole 1*g* constituting a penetrating ventilation hole 1*f* is provided to equalize differences in pressure between the interior and the exterior of the case 1. The tubular through hole 1*g* is formed so as to protrude toward the case opening side in a tubular shape by blanking the second bottom surface 1*c* from the outside toward the case opening side (one end side of the case).

The coil bobbin 4 is accommodated in the smaller diameter portion 1*b*, and has a tubular shaped bobbin tube portion 4*a* over the outer peripheral surface of which a coil 5 is wound, and a first and a second flanges 4*b* and 4*c* integrally formed with both end parts of the bobbin tube portion 4*a*. The coil bobbin 4 has a construction so as to be incorporated into the smaller diameter portion 1*b* of the case 1 in such a manner that the fixed iron core 3 is inserted into the tubular hole of the bobbin tube portion 4*a*.

The first and the second flanges 4*b* and 4*c* are each formed so as to have a smaller diameter than the inner diameter of the smaller diameter portion 1*b*. The first flange 4*b* disposed on the side of the first bottom surface 1*a* is provided at the surface abutting on the first bottom surface 1*a* of the case 1, with a step part 4*d* for engaging with the corresponding step part 1*h* formed on the first bottom surface 1*a*. This prevents the coil bobbin 4 from being displaced in the radial direction after being positioned in the smaller diameter portion 1*b*. On the other hand, the second flange 4*c* disposed on the opening side is reinforced so as to have a thicker wall than the first flange 4*b*, and is incorporated into the smaller diameter portion 1*b* so as to be substantially flush with the tube end part of the smaller diameter portion 1*b*. From the outer peripheral edge of the second flange 4*c*, a case mounting piece 4*e* and a contact mounting piece 4*f* protrude in the direction of the outer diameter side so as to be opposed to each other substantially in the direction of the diameter. These mounting pieces 4*e* and 4*f* are formed with a slight step 4*g* relative to the second flange 4*c* on the bottom side so that the surfaces of the mounting pieces 4*e* and 4*f* have a slight difference in level from the surface of the second flange 4*c* in order that the mounting pieces 4*e* and 4*f* be abutted (placed) on the second bottom surface 1*c* with the coil bobbin 4 positionally incorporated into the smaller diameter portion 1*b*.

Furthermore, in the vicinity of the case mounting piece 4*e* of the outer peripheral edge of the second flange 4*c*, a reinforcing rib 4*h* protrudes toward the case opening, and the case mounting piece 4*e* is formed so as to be thick-walled in a state contiguous with the reinforcing rib 4*h*. At the tip portion of the case mounting piece 4*e*, there is provided a mounting hole 4*i* having a slightly larger diameter than the outer diameter of the tubular through hole 1*g* penetrating the second bottom surface 1*c*, and at the end of the mounting hole 4*i* on the case opening side, a larger diameter hole 4*j* is formed in a ring-shape.

With this structure, in order to assemble the coil bobbin 4 into the case 1, the following steps are taken: First, while inserting the bobbin tube portion 4*a* into the fixed iron core 3, the mounting hole 4*i* of the case mounting piece 4*e* is fitted over the tubular through hole 1*g* with the tip end of the tubular through hole 1*g* projecting toward the case opening side, and the projected tip end of the tubular through hole 1*g* is, by means of a tool, expanded and pressed onto the hole edge side (outer diameter side) to be formed as the folded tip portion 1*i* engaging with the larger diameter hole 4*j*. As a result, the mounting hole 4*i* of the case mounting piece 4*e* is set to be supported between the second bottom surface 1*c* of the case 1 and the folded tip portion 1*i*. Thereby, the coil bobbin 4 is fixed to the case 1 in one end so as to prevent the slipping-off thereof, which constitutes the first fixing part S1, as well as the ventilation hole 1*f* communicating with the case 1 is formed. At this time, the depth D of the groove of the larger diameter hole 4*j* is set to substantially equal to the plate thickness of the folded tip portion 1*i*. Thereby, when the coil bobbin 4 is fixed to the case 1, the surface of the folded tip portion 1*i* on the case opening side is set to be flush with the surface of the outer peripheral edge (case mounting piece 4*e*) of the larger diameter hole 4*j*.

Thus, the ventilation hole if is formed and remains open communicating within the case 1 and the case mounting piece 4*e* of the coil bobbin 4 is fixed to the case 1. In this sate, while ring-shaped double-faced tape 6 is adhered over the substantially flush surfaces of the folded tip portion 1*i* on the case opening side and of the outer peripheral edge of the larger diameter hole 4*j* so as to cover the both surfaces, a ventilating material 7 (air-permeable filter or air-permeable seal) which is waterproof is adhered over the surface on the opening side of the double-faced tape 6 so as to close the ventilation hole 1*f*. Thereby, the tubular through hole 1*g* is set to function as the ventilation hole 1*f* which is waterproof but still air-permeable, and the tubular through hole 1*g* of the first fixing part S1 of the coil bobbin 4 also serves as the ventilation hole if for adjusting atmospheric pressure.

From the viewpoint of air-permeability alone, it is important only that the air-permeable filter 7 have a length so as to extend to the folded portion 1*i* without reaching the case mounting piece 4*e*, but taking waterproofing into consideration, it is necessary to provide the double-faced tape 6 and the air-permeable filter 7 so as to extend to the case mounting piece 4*e* exceeding the folded portion 1*i*, as in the above-described embodiment, in order to block water penetrating between the inner peripheral surface of the larger diameter hole 4*j* and the tip end of the folded portion 1*i*. Thereby functions of both air-permeability and waterproofing in the first fixing part S1 can be provided. Also, in this case, as in the above-described embodiment, the air-permeable filter 7 can be mounted on the flat surface formed by the folded portion 1*i* and the case mounting piece 4*e* because the groove depth D of the larger diameter hole 4*j* is set to equal to the plate thickness of the folded portion 1*i* so as to substantially make the surfaces on the case opening side of the outer peripheral edge of the larger diameter hole 4*j* flush with those of the folded portion 1*i*. This enables improvement in mountability and waterproofing. Furthermore, even when setting the groove depth D of the larger diameter tubular hole 4*j* greater than the plate thickness of the folded portion 1*i*, the air-permeable filter 7 can be mounted so as to be planar. In this case, although the double-faced tape 6 and the air-permeable filter 7 are not adhered to the folded portion 1*i*, air-permeability and waterproofing can be ensured.

On the other hand, a pair of mounting holes 4*m* and 4*n* is formed in the contact mounting piece 4*f* in the circumferential direction, and the base ends of external lead-out terminals 10 are integrally fixed to the mounting holes 4*m* and 4*n* by pins 10*a* so that the external lead-out terminals 10 are interconnected with contact plates 8*a* and 9*a* which are provided with a movable contact 8 and a fixed contact 9, respectively. Thereby, the coil bobbin 4 is supportedly fixed to the case 1 also at the position of the contact mounting piece 4*f* of the coil bobbin 4, which constitutes a second fixing part S2 of the coil bobbin 4.

Each of the contact plates 8*a* and 9*a* is interconnected in series with an external power source (not shown) and the coil 5. The coil 5 is set to be switched between energization (excitation) and deenergization (non-excitation) in accordance with the turning on/off (engagement/disengagement) of each of the contacts 8 and 9. As a consequence, the fixed iron core 3 is switched between magnetization and demagnetization, and thus constitutes the vibration generating part for the diaphragm of the present invention.

4*p* is a protruding piece for supporting the contact plate 9*a* of the fixed contact 9, and is integrally formed with the outer peripheral edge of the second flange 4*c* of the coil bobbin 4, being disposed between the case mounting piece 4*e* and the contact mounting piece 4*f*.

On the other hand, the base end of the movable iron core 11 is integrally mounted to the central part of the diaphragm 2 of which the peripheral edge 2*a* is fixed to the flange part 1*e* of the case 1 as described above. The extreme end of the movable iron core 11 is opposed to that of the fixed iron core 3 fixed on the case bottom side with space of an air gap G, and is attracted to the fixed iron core 3 by being magnetized in accordance with the energization of the coil 5, moving toward the fixed iron core 3 side against the elastic force of the diaphragm 2. Furthermore, the movable iron core 11 is provided with a step part 11*a*, with which the tip end of the contact plate 8*a* of the movable contact 8 engages, moving the movable contact 8 in accordance with the above-mentioned movement of the movable iron core 11 toward the fixed iron core 3 side. When the movable iron core 11 moves and approaches the fixed iron core 3, with the distance between the movable iron core 11 and the fixed core 3 becoming a predetermined stroke narrower than the air gap G, then the disconnection (OFF, disengagement) between the movable contact 8 and the fixed contact 9 is executed, with the result that the coil 5 becomes deenergized and the fixed iron core 3 is demagnetized, and thereby the movable iron core 11 returns to the original position by virtue of the elastic restoring force of the diaphragm 2. Upon the returning of the movable iron core 11, the movable contact 8 and the fixed contact 9 are again engaged with each other and energize the coil 5, thereby causing the movable iron core 11 to be attracted to the fixed iron core 3. By such a repetition of the energizing/deenergization of the coil 5, the present embodiment is constituted so that the diaphragm 2 vibrates and produces sound. A resonance plate 12 formed integrally with the movable core 11 resonates to emit a honking sound, thus constituting the horn for a vehicle H.

Here, reference symbol S denotes a stay for mounting the horn on a vehicle.

In the embodiment of the present invention which has a structure as described above, the repetition of the energization/deenergization of the coil 5 based on the operation of an operating implement causes the horn for a vehicle H to produce sound. In this case, the coil bobbin 4 incorporated into the smaller diameter portion 1*b* of the case 1 is fixed securely to the case by means of the first and second fixing parts S1 and S2 opposing each other in the direction of the diameter. Here, the first fixing part S1 is fixed so that the mounting hole 4*i* is supported between the second bottom surface 1*c* and the folded tip portion 1*i*, by fitting the tubular through hole 1*g*, which projects (penetrates) toward the case opening side, into the mounting hole 4*i* of the case mounting piece 4*e*, and folding the penetrating tip end of the tubular through hole 1*g* toward the hole edge side of the mounting hole 4*i* to constitute the folded piece 1*i*. As a consequence, no fixing member is exposed outside the second bottom surface 1*c* of the case 1, unlike the conventional coil bobbin 4 in which the heat-caulked tightening part is exposed to the outside. This realizes the avoidance of the inconvenience of damage caused by the impact of debris. Furthermore, the present embodiment has a feature such that the coil bobbin 4 is fixed to the case 1 using the case mounting piece 4*e* protruding from the second flange 4*c* which is the flange on the case opening side of the coil bobbin 4. Consequently, even if the case mounting piece 4*e* is made to have thick walls so as to increase the strength of the fixing part, it is unnecessary to shift the part where the coil 5 is wound to the case opening side, unlike the conventional coil bobbin 4 in which the fixing part is disposed on the flange on the bottom surface side, and also there is no inconvenience in increasing the size of the case 1.

Moreover, in the present embodiment, because with respect to the fixing of the coil bobbin 4 to the case 1, the mounting hole 4*i* is fixed so as to be held between the second bottom surface 1*c* and the folded tip portion 1*i* by folding the penetrating tip end of the tubular through hole 1*g* formed in the case 1 toward the larger diameter hole 4*j* side of the mounting hole 4*i* so that the tip end of the tubular through hole tube 1*g* expands, the tubular through hole 1*g* can be left open as it is to serve as a ventilation hole 1*f* which allows equalization of the difference in atmospheric pressure between the interior and the exterior of the case. In the present embodiment, therefore, it is possible, while smoothly performing a forced vibration of the diaphragm and thereby providing a horn H with stable sound production, to employ the tubular through hole 1*g* for fixing the coil bobbin 4 to the case body 1 to also serve as the ventilation hole 1*f*, obviating the need to pierce another ventilation hole in the case. This permits the simplification of structure and consequently the simplification of production processes.

In addition, in this embodiment, the surface of the folded piece 1*i* constituting the surface on the case opening side of the ventilation hole 1*f* and the surface of the case mounting piece 4*e* are substantially flush with each other, and over these surfaces which are substantially flush with each other, the air-permeable filter 7 is adhered in a planar state, which can provide reliable waterproofing.

While the invention has been described in its preferred embodiment, obviously many modifications and variations of the present invention are possible in the light of the above teachings. It is therefore to be understood that within the scope of the appended claims, the invention may be practiced otherwise than as specifically described.

What is claimed is:

1. A horn for a vehicle, comprising:

a cylindrical case that defines an opening having an axis, the cylindrical case also having a bottom that has surfaces that define a tubular through hole having an axis that is substantially parallel to the axis of the opening;

a diaphragm that covers the opening of the cylindrical case; and a coil bobbin that vibrates the diaphragm, the coil bobbin being mounted at the bottom of the cylindrical case, the coil bobbin having surfaces that define a mounting hole; wherein the surfaces of the bottom that define the tubular through hole are disposed along the surfaces of the coil bobbin that define the mounting hole so as to extend through the mounting hole of the coil bobbin, the surfaces of the bottom of the cylindrical case that define the tubular through hole having tip portions that extend onto the surfaces of the coil bobbin that define the mounting hole so as to hold the coil bobbin between the folded tip portions and the bottom of the cylindrical case.

2. The horn for a vehicle as claimed in claim 1, wherein said tubular through hole serves as a ventilation hole of the cylindrical case.

3. The horn for a vehicle as claimed in claim 2, further including an air-permeable, waterproof filter provided at the folded tip portions so as to seal said tubular through hole.

4. The horn as claimed in claim 3, wherein the mounting hole is formed in a mounting piece, the mounting piece protruding through the coil bobbin in the direction of the outer diameter of the coil bobbin, and a larger diameter hole portion engaged by the penetrated tip portion is formed at the end portion of said mounting hole on the side of the case opening.

5. The horn as claimed in claim 4, wherein the filter is provided so as to extend beyond the tip portions to the mounting piece.

6. The horn for a vehicle as claimed in claim 5, wherein a surface of the mounting piece closest to the case opening is substantially either flush with or greater in height than a surface of the folded tip portion closest to the case opening.

* * * * *